US009935350B2

(12) United States Patent
Oppelt

(10) Patent No.: US 9,935,350 B2
(45) Date of Patent: Apr. 3, 2018

(54) STANDING WAVE DAMPING ON A WAVEGUIDE CARRYING A SIGNAL

(71) Applicant: Ralph Oppelt, Uttenreuth (DE)

(72) Inventor: Ralph Oppelt, Uttenreuth (DE)

(73) Assignee: Siemens Aktiengesellschaft, München (DE)

( * ) Notice: Subject to any disclaimer, the term of this patent is extended or adjusted under 35 U.S.C. 154(b) by 273 days.

(21) Appl. No.: 14/972,304

(22) Filed: Dec. 17, 2015

(65) Prior Publication Data

US 2016/0181684 A1 Jun. 23, 2016

(30) Foreign Application Priority Data

Dec. 17, 2014 (DE) ..... 10 2014 226 163

(51) Int. Cl.
*H01P 5/02* (2006.01)
*H01P 1/22* (2006.01)
*H01P 5/12* (2006.01)

(52) U.S. Cl.
CPC ..... *H01P 1/225* (2013.01)

(58) Field of Classification Search
CPC ..... H01P 5/00; H01P 5/02; H01P 5/12
USPC ..... 333/109–112, 116, 117, 122
See application file for complete search history.

(56) References Cited

U.S. PATENT DOCUMENTS 3,484,724 A * 12/1969 Podell ..... H03H 7/21 333/112
7,528,680 B2 * 5/2009 Kebinger ..... H03H 1/0007 333/109
7,608,778 B2 10/2009 Reykowski
8,207,737 B2 6/2012 Greim
8,526,902 B2 9/2013 Biber et al.
2007/0201178 A1 8/2007 Reykowski
2010/0148775 A1 6/2010 Greim
2013/0063221 A1 3/2013 Biber et al.
(Continued)

FOREIGN PATENT DOCUMENTS

DE 10104260 C2 5/2003
DE 102006009040 A1 9/2007
(Continued)

OTHER PUBLICATIONS

German Office action for related German Application No. 10 2014 226 163.5, dated Apr. 30, 2015, with English Translation.
(Continued)

*Primary Examiner* — Dean Takaoka
(74) *Attorney, Agent, or Firm* — Lempia Summerfield Katz LLC

(57) ABSTRACT

A device for damping a standing wave on a waveguide carrying a signal is provided. The device includes at least one pair of an impedance-up-transforming and an impedance-down-transforming Boucherot bridge is connected into the waveguide. The two Boucherot bridges bring about locally increased impedances and inductance values, with the result that a significantly improved standing wave suppression or damping is obtained. The down-transforming Boucherot bridge is connected directly behind the up-transforming bridge, with the result that down-transformation to the original impedance of the waveguide again can be carried out and a signal reflection can thus be avoided.

20 Claims, 5 Drawing Sheets

(56) References Cited

U.S. PATENT DOCUMENTS

| | | | |
|---|---|---|---|
| 2013/0181716 | A1 | 7/2013 | Greim |
| 2014/0347143 | A1 | 11/2014 | Oppelt |

FOREIGN PATENT DOCUMENTS

| | | | |
|---|---|---|---|
| DE | 102008063458 | B4 | 3/2012 |
| DE | 102011005349 | A1 | 9/2012 |
| DE | 102011079596 | A1 | 1/2013 |
| DE | 102013209450 | A1 | 11/2014 |
| EP | 0337204 | A1 | 10/1989 |

OTHER PUBLICATIONS

Rothammel K.: Antennenbuch, DM2ABK, Telekosmos-Verlag, Franckhsche Verlagshandlung, Stuttgart, 4. Auflage, pp. 116-118, 1973.

* cited by examiner

STANDING WAVE DAMPING ON A WAVEGUIDE CARRYING A SIGNAL

CROSS-REFERENCE TO RELATED APPLICATION

This application claims priority under 35 U.S.C. § 119 to German Patent Application No. 102014226163.5, filed on Dec. 17, 2014, the entire content of which is incorporated herein by reference.

FIELD

The invention relates to the damping of disturbing standing waves on signal-carrying waveguides.

BACKGROUND

During the operation of ungrounded sources or loads, so-called standing waves can occur if, in the line leading from the source to the load, e.g., in a coaxial line, the outgoing current in the inner conductor of the coaxial line does not exactly correspond to the return current in the outer conductor of the coaxial line. Therefore, a non-shielded current arises on the outer conductor and is being referred to as a standing wave or as a common-mode wave.

Such standing waves fill the free space surrounding the line with an electromagnetic field and, therefore, depending on the area of application of the line, may bring about disadvantageous and disturbing effects, e.g., undesired oscillations in amplifier systems or dangerous effects on the immediate surroundings such as skin burns on patients in a magnetic resonance installation.

For standing wave suppression, various so-called standing wave traps have been proposed, such as in EP0337204A1. In the conventional art, in order to realize a standing wave trap, locally a part of the coaxial line is rolled up to form an inductance. The shield of the coaxial line is bridged at the beginning and end of the resultant coil with a capacitance, such that the capacitance together with the inductance forms a parallel resonant circuit at the operating frequency of the line. On account of the finite coil quality factor, the loss resistance, $R_p$, in parallel with the coil remains as a residual path for the standing wave. It holds true here that the standing wave suppression becomes better with higher $R_p=\omega LQ$. In this case, $\omega$ is the angular frequency, L, is the inductance of the coil and Q is the coil quality factor. Accordingly, a good suppression requires a high coil quality factor Q, achievable via a large volume of the coil, and/or a high inductance, L, achievable via a high number of turns and again via a large coil volume. However, the measures for enlarging the coil volume and/or for increasing the number of turns are accompanied by a corresponding lengthening of the coaxial cable rolled up to form the coil, and thus increasing the damping of the useful signal in the cable, which is also referred to as push-pull signal.

Furthermore, a disadvantageous effect arises from the fact that such standing wave traps are special components which generally are expensive and are poorly handleable in particular on account of the spatial dimensions. Thus, conventional standing wave traps also cannot be fitted as an SMD (SMD: "surface-mounted device").

As an alternative to the standing wave traps described for suppressing standing waves, the so-called Boucherot bridge, may be used. As used herein, the term "Boucherot bridge" encompasses its plain and ordinary meaning, including, but not limited to a bridge which consists of two identical inductances (L1, L2 where L1=L2) and capacitances (C1, C2 where C1=C2). Although cost-effective and possible to fit as an SMD, the inductance value is fixedly predefined by calculation for complying with the characteristic impedance for the useful signal. This inductance value is relatively low. With regard to the common-mode suppression, only half the inductance of the Boucherot bridge actually takes effect, with the result that the suppression effect of the bridge is ultimately insufficient in most cases. Even a cascading configuration of a multiple Boucherot bridges does not lead to a significant improvement. The corresponding individual suppression resistances of the bridges are in series for the common-mode wave, and so the resistances are added together. If e.g., two bridges having identical suppression resistances are used, then the total resistance corresponds to double the suppression resistance. The resulting total resistance is comparable, in principle, with the Rp mentioned above. Since Rp is generally very much greater than the reference impedance (generally 50Ω), the example demonstrated yields only 6 dB more suppression for a cascade configured with two identical Boucherot bridges (2-fold cascade), 9.5 dB for a 3-fold cascade, 12 dB for a 4-fold cascade, etc.

SUMMARY

The existing approaches for damping standing waves accordingly have various disadvantages. Therefore, it is an object of the present invention to specify a cost-effective and reproducible method that may be implemented in a corresponding system for effectively influencing standing waves.

The concept underlying the invention resides in increasing the inductance value of a Boucherot bridge itself, with the result that a standing wave is effectively damped. The increased inductance value together with a correspondingly reduced capacitance value causes an impedance transformation to an increased intermediate impedance.

A cascade including at least one impedance-up-transforming Boucherot bridge and one impedance-down-transforming Boucherot bridge arrangement is used, where each of the Boucherot bridge arrangements can be constructed from one or more Boucherot bridges. The up-transforming bridge arrangement has an increased impedance with respect to the impedance of the waveguide and has the effect of locally increasing impedance. Hence, an effective damping of the standing wave are achieved. The down-transforming bridge arrangement is used to obtain the original impedance of the waveguide again, with the result that signal reflections are avoided. In other words, a Boucherot bridge arrangement is used to carry out transformation e.g. from the typical impedance of a coaxial line of Z1=50Ω to 500Ω and then back again from 500Ω to 50Ω. This transformation results in locally significantly higher inductance values and hence a significantly improved standing wave suppression or damping.

A Boucherot bridge or Boucherot bridge arrangement brings about the matching of two electrical ports having impedances Z1 and Z2 having generally different magnitudes if the impedance ZB of the Boucherot bridge or Boucherot bridge arrangement corresponds to the geometric mean of the individual impedances, e.g., by the selection of suitable parameters of the capacitances and inductances forming the bridge, such as maintaining the relationship ZB=sqrt(Z1*Z2). In other words, a Boucherot bridge arrangement is configured in such a way that its impedance ZB corresponds to the root of the product of the impedances Z1, Z2 of the electrical components to be connected to the bridge. A Boucherot bridge or Boucherot bridge arrangement configured with an impedance ZB=sqrt(Z1*Z2) therefore makes it possible that an electrical port having an impedance Z1 can be connected to an electrical component having an impedance Z2 in a manner free of reflections with the aid of said Boucherot bridge or Boucherot bridge arrangement. "Antennenbuch" ["Antenna book"] (K. Rothammel, DM2ABK, Telekosmos-Verlag, Franckhsche Verlagshandlung, Stuttgart, 4th edition, 1973, pages 116 118) notes that for connecting a 20Ω line to a 240Ω line, a Boucherot bridge having an impedance ZB=sqrt(20 Ω*240Ω)≈70Ω can be connected between the two lines, thus resulting in the required capacitances and inductances of the Boucherot bridge in a simple manner.

The electrical ports may be ends or beginnings of electrical lines.

Given known impedance values Z1, Z2 of the electrical components to be connected to the Boucherot bridge or Boucherot bridge arrangement, the required impedance ZB of the Boucherot bridge or Boucherot bridge arrangement can easily be calculated and the inductances and capacitances forming the Boucherot bridge or Boucherot bridge arrangement may be selected.

A device according to an embodiment for damping a standing wave on a waveguide carrying a signal in a propagation direction P and having an impedance Z1 includes an input for feeding the signal from the waveguide from a first section of the waveguide into the device having an impedance Z1A. The device further includes an output for outputting the signal from the device into the waveguide into a second section of the waveguide having an impedance Z1B, one or more groups of impedance-transforming Boucherot bridge arrangements. The Boucherot bridge arrangements for each group are connected in series or in a cascade between the input for feeding the signal S into the device and the output for outputting the signal S from the device, such that the signal from the first section of the waveguide successively passes through the Boucherot bridge arrangements of the first group in order to be fed into the second section of the waveguide. In this case, each of the Boucherot bridge arrangements of the respective group has an impedance greater than the impedance Z1 of the waveguide.

What is achieved by the use and design of at least two Boucherot bridge arrangements BBup1, BBdn1 according to the disclosed embodiments is that a significantly increased inductance value is present within the impedance-up-transforming bridge BBup1 and within the impedance-down-transforming bridge BBdn1, bringing about a significantly improved damping of standing waves for the signal S passing through the device. Secondly, the impedance-down-transforming bridge BBdn1 connected downstream has the effect that the output of the device, can be matched to the original impedance Z1 of the waveguide or to the impedance Z1B of the second section, while preventing signal reflections.

The connection of each Boucherot bridge arrangement to its respective Boucherot group is configured in such a way that the signal can pass through the respective group in a manner free of reflections, with the result that signal losses are minimized.

Each group of Boucherot bridge arrangements and any respective groups are configured in such a way that within the respective group as viewed in the propagation direction P of the signal through the device, an impedance up-transformation from an input impedance to a respective intermediate impedance is carried out, so that the respective intermediate impedance is higher than the input impedance. The input impedance may be the impedance Z1 of the waveguide. Subsequently, an impedance down-transformation from the respective intermediate impedance to a lower impedance is carried out, in particular back to the input impedance. What is achieved thereby is that locally increased impedances and inductances are present, thus resulting in an effective damping of the standing wave.

In this case, in at least one group the up-transformation from the input impedance to the respective intermediate impedance is carried out in a different number of acts than the down-transformation from the respective intermediate impedance to the lower impedance.

One (or more) group of Boucherot bridge arrangements may include more than two Boucherot bridge arrangements. When viewed in the propagation direction P of the signal through the device, the second Boucherot bridge arrangement of the group has a higher impedance than the first Boucherot bridge arrangement of the same group. The last Boucherot bridge arrangement of the group has a lower impedance than the penultimate Boucherot bridge arrangement of its group.

In this case, the first Boucherot bridge arrangement of the group, as viewed in the propagation direction P of the signal through the device, has a higher impedance than the last Boucherot bridge arrangement of the group. Accordingly, the up-transformation from Z1 to the intermediate impedance is carried out in fewer acts than the down-transformation. By way of example, given three bridge arrangements in the group: a transformation to the highest impedance is carried out, subsequently a down-transformation to a lower impedance is carried out and, finally, a further down-transformation to the lowest impedance, e.g. the input impedance or the impedance Z1 of the waveguide, is carried out.

Alternatively, the first Boucherot bridge arrangement of the group, as viewed in the signal propagation direction of the signal through the device, has a lower impedance than the last Boucherot bridge arrangement of the group. Accordingly, the up-transformation from Z1 to the intermediate impedance is carried out in more acts than the down-transformation.

In one embodiment, at least one group of Broucherot bridge arrangements includes one pair of Boucherot bridge arrangements, e.g. exactly two Boucherot bridge arrangements, where the impedances of the two Boucherot bridge arrangements of the pair are identical. Devices using at least one pair of identical Boucherot bridge arrangements are expedient to produce and constructed in a simple manner based on the identical impedances.

The Boucherot bridge arrangements are constructed in such a way that each Boucherot bridge arrangement comprises at least one Boucherot bridge. A simple and cost-effective construction of the Boucherot bridge arrangements is thus possible. Additionally or alternatively, at least one of the Boucherot bridge arrangements includes multiple Boucherot bridges configured and interconnected with one another in such a way that the one Boucherot bridge arrangement has the impedance predefined for the one Boucherot bridge arrangement. A greater flexibility of the bridge arrangements is thereby achieved.

In at least one group, at least two successive Boucherot bridge arrangements of the respective group are directly connected to one another. In this case, the "direct" connection is distinguished as connected bridge arrangements that are spatially arranged "closely" adjacent such that for the length X of a connection line required for producing the connection, $X \ll \lambda/4$, wherein λ is the wavelength of the signal S. Specifically, the impedance of the connection line is then also irrelevant. In this case, it can be assumed that signal losses in said connection line are negligible.

In at least one group all the Boucherot bridge arrangements of the respective group are directly connected to one another.

In a further embodiment, the device includes at least a first and a second group of such impedance-transforming Boucherot bridge arrangements, where the last Boucherot bridge arrangement of the first group in the signal flow direction is connected to the first Boucherot bridge arrangement of the second group in the signal flow direction via a line W2, rather than directly. In other words, the two bridge arrangements are distributed spatially over the waveguide. For example, the line W2 is the waveguide or has the same properties as the waveguide, such as an impedance Z1. A plurality of separate standing wave traps result that can be arranged in a manner distributed over the length of the waveguide. This is advantageous particularly if the waveguide has a long length, e.g. of the order of magnitude of several meters.

The embodiments presented disclose a large number of advantages. For example, since the Boucherot bridges consist only of capacitances and inductances, the standing wave trap constructed from the Boucherot bridges may be kept small. The corresponding standing wave trap may thus be realized from expedient standard components and, on account of the small dimensions, is readily handleable and can be fitted as an SMD. Moreover, it is possible to produce standing wave traps from components with narrow tolerances, such that in mass production an adjustment may become unnecessary, that in turn maintains lower costs.

A further advantage of the use of impedance-transforming bridges is the bandpass filter effect in the vicinity of the useful signal. That is, the frequencies in the more remote neighborhood of the useful frequency are correspondingly damped. A further contribution is made to the stabilization of amplifier systems because at these frequencies the push-pull signal is then also correspondingly attenuated, and an undesired perturbation with possibly severe oscillations thus becomes less likely.

The invention and exemplary embodiments are explained in greater detail below with reference to a drawing. The scope of the present invention is defined solely by the appended claims and is not affected to any degree by the statements within this summary. The present embodiments may obviate one or more of the drawbacks or limitations in the related art.

DETAILED DESCRIPTION

Identical reference signs in different figures identify identical component parts except where otherwise indicated.

Figure 1:
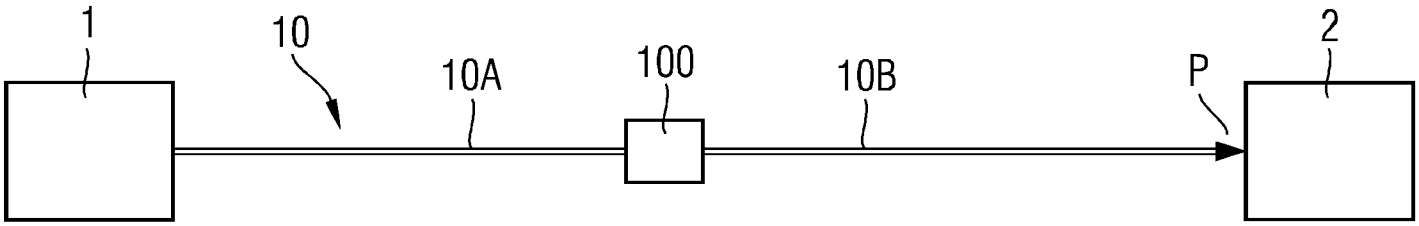
FIG. 1 illustrates one exemplary system for a device 100 for damping standing waves.

FIG. 1 illustrates one exemplary application for a device 100 for damping standing waves on a waveguide 10 having an impedance Z1. The waveguide 10 is used to conduct an electrical signal S from a source 1 to a load 2. The propagation direction of the signal S is represented by an arrow P. In the application shown in FIG. 1, the source 1 is a receiving coil of a magnetic resonance imaging apparatus (MRI, not shown), and a module 2 of the MRI for signal processing represents the load 2. The waveguide 10 is a two-pole signal-carrying line comprising a first wire 11 and a second wire 12, that may be embodied as a coaxial line 10. The first wire 11 can represent the ground of the coaxial line 10, while the second wire 12 is the inner conductor of the coaxial line 10. The receiving coil 1 and also the signal processing module 2 are not illustrated in detail and will not be described any further at this juncture. Embodiments are contemplated to be usable and applicable in other applications.

In the operating state of the MRI, the waveguide 10 conducts the electrical signal S from the receiving coil 1 to the signal processing module 2. As described in the introduction, a disturbing standing wave can form on the coaxial line 10. In order to dampen or completely suppress such a standing wave, the device 100 is used. Device 100 is integrated between a first section 10A and a second section 10B of the waveguide 10.

Figure 2:
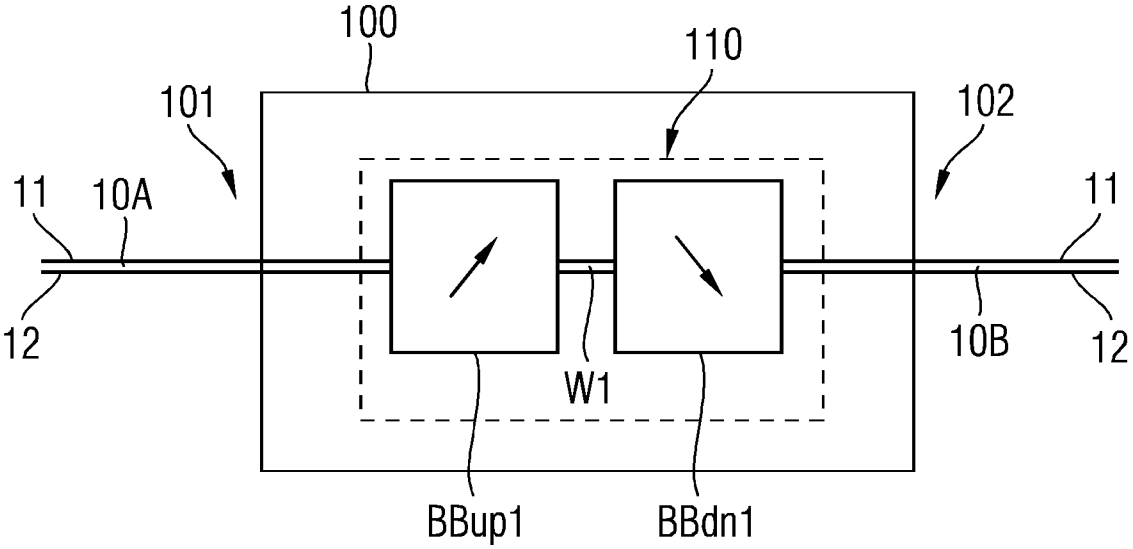
FIG. 2 illustrates one embodiment of the device for damping a standing wave.

FIG. 2 illustrates an embodiment of the device 100 for damping a standing wave on the waveguide 10. The waveguide 10 here consists of a first section 10A having an impedance Z1A and a second section 10B having an impedance Z1B. As is customary in the art, Z1A=Z1B=Z1=50Ω is assumed below.

The damping device 100 comprises an input 101, via which the signal S from the first section 10A of the waveguide 10 is fed into the device 100, and an output 102, via which the signal S is output from the device 100 into the second section 10B of the waveguide 10. The first section 10A, the device 100 and the second section 10B are therefore connected in a cascade in the signal propagation direction P.

Furthermore, the damping device 100 comprises a first pair 110 of cascade-connected impedance-transforming Boucherot bridge arrangements BBup1, BBdn1 having corresponding impedances Z_up1 and Z_dn1, respectively. The bridge arrangements BBup1, BBdn1 are connected to one another via a line W1 having an impedance Z_W1. Ideally, the bridge arrangements BBup1, BBdn1 are directly connected to one another.

In this case, a "direct" connection is provided e.g., if the connected bridge arrangements BBup1, BBdn1 are spatially so "closely" adjacent that for the length X of the connection line necessary for producing the connection it holds true that $X \ll \lambda/4$, wherein X is the wavelength of the signal, S. When this relationship is maintained, the impedance of the connection line is also irrelevant.

The signal S fed into input 101 is fed to the first pair 110 of impedance-transforming Boucherot bridge arrangements BBup1, BBdn1, wherein the bridge arrangements BBup1, BBdn1 are configured by selection of the required capacitances and inductances in such a way that the bridge BBup1 passed through first in the signal propagation direction P has an impedance-up-transforming effect and the bridge BBdn1 passed through second in the signal propagation direction P has an impedance-down-transforming effect.

Boucherot bridges and also cables are passive, reciprocal systems with regard to signal propagation direction. Signals can thus pass through these systems in the forward direction and in the reverse direction and have the same damping values in the case of losses in both directions. As described above, a Boucherot bridge having an impedance ZB=sqrt (Z1*Z2) provides reflection-free transmission of a signal from a line having an impedance Z1 to a line having an impedance Z2. In this case, the direction of the signal passing through the bridge is unimportant. As used herein, signal propagation direction, P, is used merely for explanation purposes, and does not imply that a signal may travel in one direction only.

The Boucherot bridge arrangement BBup1 is connected on the input side to the first section 10A of the waveguide 10 and on the output side to the line W1 or directly to BBdn1. The Boucherot bridge arrangement BBdn1 is connected to the line W1 or directly connected to BBup1 and the second section 10B of the waveguide 10. As explained in the introduction, Z_up1=sqrt(Z1A*Z_W1)=sqrt(Z1*Z_W1) and Z_dn1=sqrt(Z_W1*Z1B)=sqrt(Z_W1*Z1) accordingly hold true, avoiding signal reflections. The impedance Z_W1 is accorded the role of an intermediate impedance ZW=Z_W1.

Ideally, the bridge arrangements BBup1, BBdn1 are directly connected to one another.

A damping of a standing wave on the waveguide 10 is then achieved because an increased impedance for the potential standing wave can be generated locally by the device 100, said impedance being at least higher than the impedance Z1 of the waveguide 10. For this purpose, the two Boucherot bridge arrangements BBup1, BBdn1 are configured in such a way that their impedances Z_up1, Z_dn1 are greater than the impedance of the waveguide 10, e.g. Z_up1>Z1, Z_dn1>Z1. Thus, higher inductance values of the Boucherot bridge arrangements result, having an advantageous effect on the damping of the standing wave.

The device 100 design of two Boucherot bridge arrangements BBup1, BBdn1, that firstly up-transformation (e.g., from Z1A=Z1=50Ω to ZW=Z_W1=500Ω) is effected with the aid of the impedance-up-transforming bridge arrangement BBup1, bringing about an effective damping of the standing wave with high intermediate impedance ZW=500Ω. Furthermore, down-transformation again from the intermediate impedance ZW=500 Ω back to Z1B=Z1=50Ω is effected with the aid of the impedance-down-transforming bridge arrangement BBdn1 in order to achieve a matching to the waveguide 10, or the second section 10B, such that the signal S can be fed in a manner free of reflections from the bridge arrangement BBdn1 into the second section 10B of the waveguide 10. If the impedances Z1A, Z1B of the first section 10A and of the second section 10B of the waveguide 10 are identical, the impedances Z_up1 and Z_dn1 of the embodiment, shown in FIG. 2, are likewise identical, e.g. Z_up1=Z_dn1.

Figure 3:
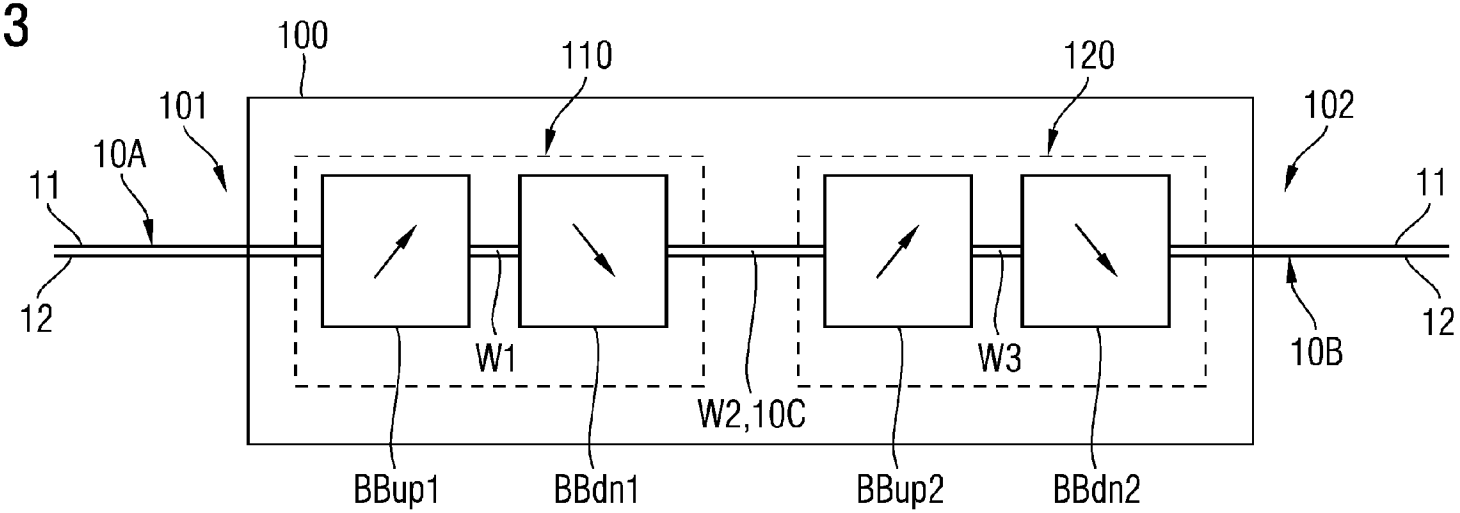
FIG. 3 illustrates a second embodiment of the device for damping a standing wave in one variant.

FIG. 3 illustrates a second embodiment of the device 100 for damping a standing wave on the waveguide 10. The damping device 100 once again includes an input 101. The signal S from the first section 10A of the waveguide 10 is fed into the device 100 via input 101. The signal S is output from the device 100 into the second section 10B of the waveguide 10 via an output 102.

In addition to the first pair 110 of Boucherot bridge arrangements BBup1 and BBdn1 as explained in association with FIG. 2, the device in the second embodiment includes a further pair 120 of cascade-connected impedance-transforming Boucherot bridge arrangements BBup2, BBdn2 having corresponding impedances Z_up2 and Z_dn2, respectively. The signal S that leaves the Boucherot bridge arrangements BBdn1 of the first pair 110 is fed to the Boucherot bridge arrangement BBup2 and then to the Boucherot bridge arrangement BBdn2 of the further pair 120. Accordingly, a cascade connection of the first section 10A of the waveguide 10, the first pair 110 of bridge arrangements BBup1, BBdn1, the further pair 120 of bridge arrangements BBup2, BBdn2 and the second section 10B of the waveguide 10 arises in the signal propagation direction P.

The functioning of the second pair 120 and of the associated bridge arrangements BBup2 and BBdn2 corresponds to the functioning of the first pair 110. The bridge arrangements BBup2, BBdn2 are configured by selection of the required capacitances and inductances in such a way that the bridge BBup2 passed through first in the signal propagation direction P has an impedance-up-transforming effect and the bridge BBdn2 passed through second in the signal propagation direction P has an impedance-down-transforming effect.

In the second embodiment shown in FIG. 3, the Boucherot bridge arrangement BBup1 of the first pair 110 is connected to the first section 10A of the waveguide 10 and via a line W1 or directly to the Boucherot bridge arrangement BBdn1, while the Boucherot bridge arrangement BBdn1 is furthermore connected via a line W2 or, if appropriate, directly to the Boucherot bridge arrangement BBup2. The Boucherot bridge arrangement BBup2, for its part, is connected via a line W3 or directly to the Boucherot bridge arrangement BBdn2 that is finally connected to the second section 10B of the waveguide 10. The lines W1, W2, W3 in this case have impedances Z_W1, Z_W2, Z_W3.

As explained in the introduction, the following relationships result: Z_up1=sqrt(Z1A*Z_W1), Z_dn1=sqrt (Z_W1*Z_W2), Z_up2=sqrt(Z_W2*Z_W3), Z_dn2=sqrt (Z_W3*Z1B). Given a corresponding design of the bridge arrangements BBup1, BBdn1, BBup2, BBdn2 e.g. by selection of suitable parameters of the capacitances and inductances that form the bridges, provides that the signal S can pass through the device 100 in a manner free of reflections.

Here, too, the impedances Z_W1, Z_W2, Z_W3 are accorded the roles of intermediate impedances ZW1=Z_W1, ZW2=Z_W2, ZW3=Z_W3. For the case where the first pair 110 and the second pair 120 of bridge arrangements BBup1, BBdn1, BBup2, BBdn2 are arranged at a distance from one another in the waveguide 10. It may be assumed that the line W2 connecting the two pairs 110, 120 to one another corresponds to the waveguide 10 and has a corresponding impedance Z_W2=Z1. Therefore, the impedance Z_W2 is not higher than the impedance of the waveguide 10.

In practice, multiple such pairs of Boucherot bridge arrangements may be arranged in a manner distributed over the waveguide at mutual distances of 30-40 cm.

A damping of a standing wave on the waveguide 10 is then again achieved via locally increased impedances generated by the device 100. For this purpose, the Boucherot bridge arrangements BBup1, BBdn1, BBup2, BBdn2 are configured in such a way that their impedances Z_up1, Z_dn1, Z_up2, Z_dn2 are greater than the impedance of the waveguide 10, e.g. Z_up1>Z1, Z_dn1>Z1, Z_up2>Z1, Z_dn2>Z1. Higher inductance values of the Boucherot bridge arrangements result, having an advantageous effect on the damping of the standing wave.

When the two pairs 110, 120 are arranged at a distance from one another in the waveguide 10 and are correspondingly connected via a further section W2=10C of the waveguide, Z_W2=Z1 would ideally hold true. It may again be assumed that Z1A=Z_W2=Z1 or Z_W2=Z1B=Z1, such that the impedances of the bridge arrangements BBup1, BBdn1 are identical, e.g. Z_up1=Z_dn1=Zx. The same applies to the impedances of the bridge arrangements BBup2, BBdn2, e.g. Z_up2=Z_dn2=Zy. At the same time it is also possible, however, for the impedances of the bridge arrangements of the different pairs 110, 120 to be different, e.g. Zx≠Zy, such that the intermediate impedance ZW1 for the first pair 110 differs from the intermediate impedance ZW3 for the second pair 120.

The device 100 with the described use and design of two pairs 110, 120 of Boucherot bridge arrangements BBup1, BBdn1 and BBup2, BBdn2, respectively, such that a first transformation e.g. from Z1A=Z1=50Ω to ZW1=500Ω is effected with the aid of the impedance-up-transforming bridge arrangement BBup1, bringing about a first effective damping of the standing wave. Transformation from the intermediate impedance ZW1=500Ω to the further intermediate impedance ZW2=Z_W2 can be effected with the aid of the impedance-down-transforming bridge arrangement BBdn1.

For embodiments where the two pairs 110, 120 are arranged at a distance from one another in the waveguide 10 and are also accordingly connected via a further section W2=10C of the waveguide, ZW2=Z_W2=Z1=50Ω holds true for the further intermediate impedance. In order to achieve this, the impedances Z_up1, Z_dn1 are identical again. In the first transformation, bridge arrangement BBup2, e.g. from Z_W2=Z1=50Ω to ZW3=700Ω is effected with the aid of the impedance-up-transforming bridge arrangement BBup2, causing a second effective damping of the standing wave.

With regard to complexity and production of the device 100, it may be preferable for the first and second pairs 110, 120 to include an up-transformation to the same intermediate impedance, e.g. to 600Ω, since different component values would not be required.

In another example, the two pairs 110, 120 are a distance from one another such that the length X_W2 of the line W2 does not maintain the relationship X_W2<<λ/4. Instead, the impedances Z_up1, Z_dn1 may be different, such that Z_W2=ZW2>Z1 holds true. The following bridge arrangement BBup2 can be configured such that, although the intermediate impedance ZW3 is greater than Z1, it is also less than or greater than ZW2. Therefore, an effective damping of a standing wave is brought about via different bridge impedances and, associated therewith, via different increased inductance values.

In both examples, the subsequent impedance-down-transforming bridge arrangement BBdn2 is configured in such a way that it effects down-transformation from the intermediate impedance ZW3=Z_W3 back to Z1B=Z1=50Ω in order to achieve a matching to the second section 10B of the waveguide 10, such that the signal S can pass free of reflections from the bridge arrangement BBdn2 into the second section 10B.

Without departing from the basic concept of the second embodiment illustrated in FIG. 3, it is possible, to arrange more than two pairs of Boucherot bridge arrangements in the waveguide 10. This plurality of pairs can then be arranged in a manner distributed over the waveguide 10 at identical distances, wherein each pair, per se, operates in the manner described in association with the embodiment depicted in FIG. 2 and the bridge arrangements of each pair are ideally directly connected to one another.

The second embodiment including a plurality of pairs 110 and 120 of bridge arrangements may be realized in a plurality of variants that differ in the order of the individual bridge arrangements in the signal propagation direction P. The embodiment depicted in FIG. 3 may correspond to a first variant of the second embodiment, where the individual bridge arrangements of the first and second pairs 110, 120 are cascade-connected in such a way that the signal passes through first the impedance-up-transforming Boucherot bridge arrangement BBup1 of the first pair 110, then the impedance-down-transforming Boucherot bridge arrangement BBdn1 of the first pair 110, then the impedance-up-transforming Boucherot bridge arrangement BBup2 of the second pair 120 and then followed by the impedance-down-transforming Boucherot bridge arrangement BBdn2 of the second pair 120.

The second embodiment in the first variant is particularly suitable where the two pairs 110, 120 are separated by a distance from one another in the waveguide 10, since it is possible to effect down-transformation from the high intermediate impedance ZW1 to the normal impedance Z1 of the waveguide 10 using the impedance-down-transforming bridge arrangement BBdn1 of the first pair 110. As a result, the first pair 110 may be connected to the second pair 120 separated at a distance by line W2 having the same properties of the waveguide 10, such that the useful signal S is not reflected during transmission via the line W2.

Figure 4:
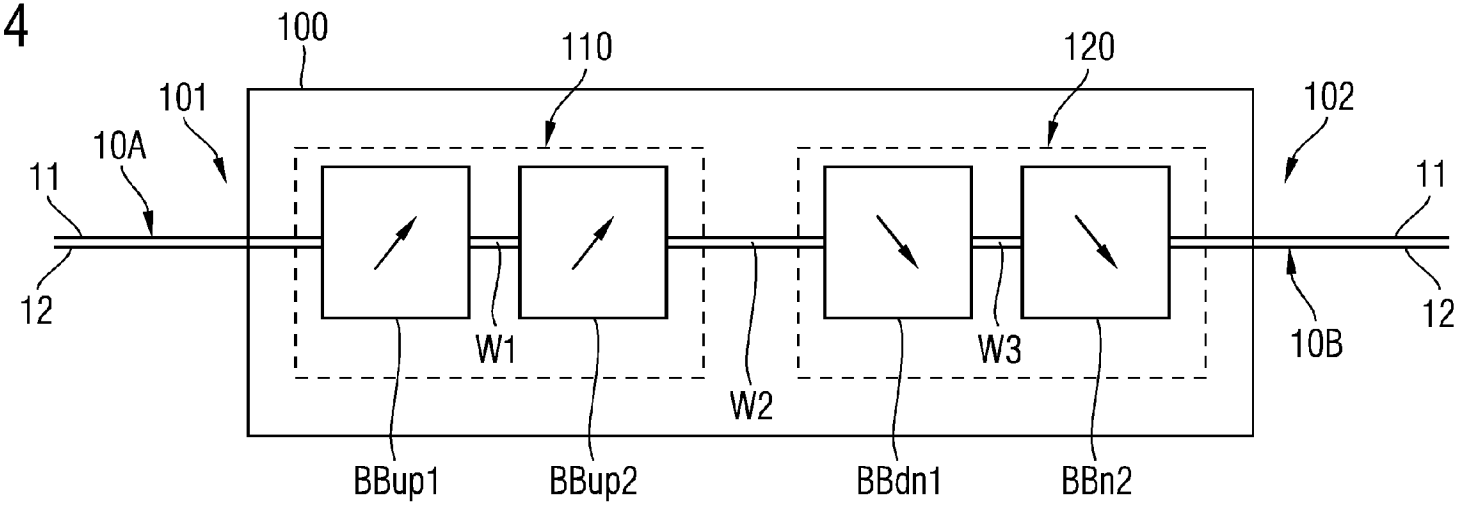
FIG. 4 illustrates the embodiment of the device of FIG. 3 for damping a standing wave in a second variant.

A second variant of the second embodiment is illustrated in FIG. 4. In the second variant, the individual impedance-transforming Boucherot bridge arrangements BBup1, BBdn1 and BBup2, BBdn2 of the first and second pairs 110, 120, respectively, are cascade-connected causing the signal S from the first section 10A firstly passes through the impedance-up-transforming Boucherot bridge arrangement BBup1 of the first pair 110. The signal then passes via a line W1 having an impedance Z_W1 or directly to the impedance-up-transforming Boucherot bridge arrangement BBup2 of the second pair 120. The signal S then passes via a line W2 having an impedance Z_W2 or directly to the impedance-down-transforming Boucherot bridge arrangement BBdn1 of the first pair 110. Then, directly connected or connected via a line W3 having an impedance Z_W3, Signal S reaches the impedance-down-transforming Boucherot bridge arrangement BBdn2 of the second pair 120. Signal S is then fed from into the second section 10B of the waveguide 10.

In the second variant of the second embodiment, the individual bridge arrangements may be configured in such a way that the signal S can pass through the bridges in a manner free of reflections. As explained, the following relationships result: Z_up1=sqrt(Z1A*Z_W1), Z_up2=sqrt(Z_W1*Z_W2), Z_dn1=sqrt(Z_W2*Z_W3), Z_dn2=sqrt(Z_W3*Z1B). Given a corresponding design of the bridge arrangements BBup1, BBdn1, BBup2, BBdn2, e.g. by selection of suitable parameters of the capacitances and inductances that form the bridges, the signal S can pass through the device 100 in a manner free of reflections.

The second variant of the second embodiment is less suitable when the pairs or the individual bridge arrangements are arranged in a manner distributed over the waveguide 10 in a spaced-apart fashion because each intermediate impedance may be considerably greater than the impedance of the waveguide 10, such that a line W1, W2, and/or W3 connecting two successive bridge arrangements would correspondingly reflect the useful signal. In order to minimize this influence, the lines W1, W2, W3 are as short as possible or the bridge arrangements may be directly connected to one another, such that a distribution over the waveguide 10 may not be practical.

An effective damping of standing waves is then achieved again via the fact that locally increased impedances are generated by the device 100. For this purpose, the Boucherot bridge arrangements BBup1, BBup2, BBdn1, BBdn2 are configured in such a way that their impedances Z_up1, Z_up2, Z_dn1, Z_dn2 are greater than the impedance of the waveguide 10, e.g. Z_up1>Z1, Z_dn1>Z1, Z_up2>Z1, Z_dn2>Z1. Higher inductance values of the Boucherot bridge arrangements are thus achieved, having an advantageous effect on the damping of the standing wave.

In both variants of the second embodiment described, the device 100 includes more than two Boucherot bridge arrangements. In the context of the description of the figures, pairs of Boucherot bridge arrangements have specifically been mentioned. For example, the second variant of the second embodiment, with two impedance-up-transforming Boucherot bridge arrangements BBup1, BBup2 and respectively two impedance-down-transforming Boucherot bridge arrangements BBdn1, BBdn2 are disclosed as connected directly one behind another. However, the second variate of the second embodiment, along with other embodiments and variants may also be realized with an odd number of bridge arrangements. By way of example, the two up-transforming bridge arrangements BBup1, BBup2 may be replaced by a single up-transforming bridge arrangement BBUP. Alternatively, the two down-transforming bridge arrangements BBdn1, BBdn2 can analogously be replaced by a single down-transforming bridge arrangement BBDN. This accordingly has the result that the device no longer comprises pairs of Boucherot bridge arrangements, but rather, groups of Boucherot bridge arrangements, wherein each group comprises one or more Boucherot bridge arrangements.

Figure 5:
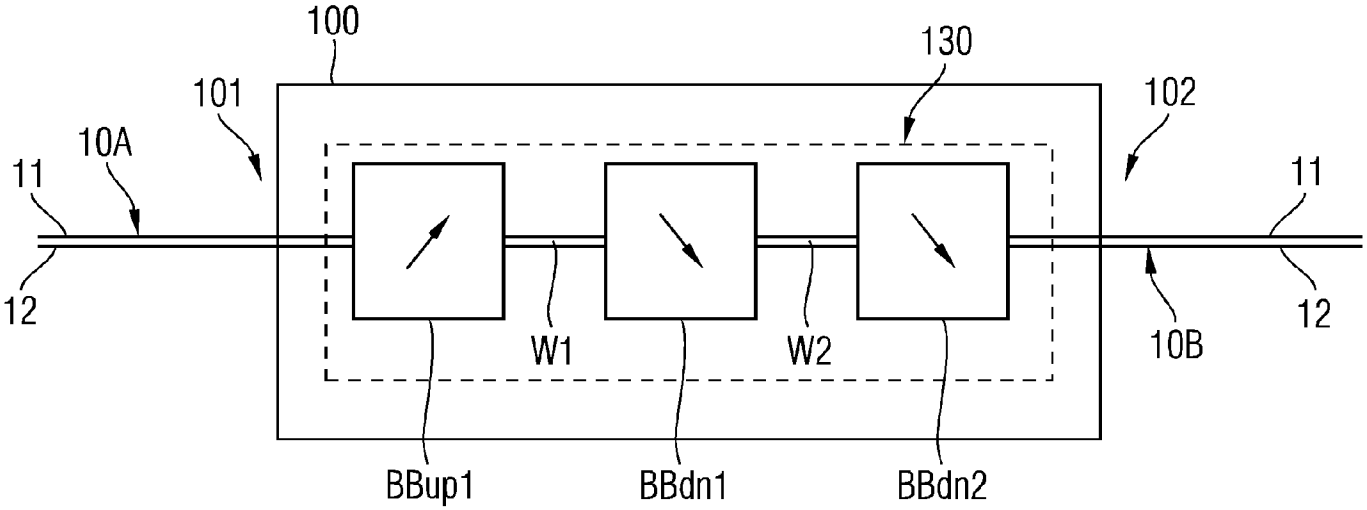
FIG. 5 illustrates yet another embodiment of the device for damping a standing wave.

FIG. 5 illustrates a third embodiment providing a group 130 of Boucherot bridge arrangements BBup1, BBdn1, BBdn2. The group 130 comprises an odd number of cascade-connected Boucherot bridge arrangements BBup1, BBdn1, BBdn2 having impedances Z_up1, Z_dn1, Z_dn2. BBup1 is connected to BBdn1 via a line W1 having an impedance Z_W1 or may be directly connected to BBdn1. BBdn1 is connected to BBdn2 via a further line W2 having an impedance Z_W2 or directly connected to BBdn2. The signal S from the first section 10A passes through the impedance-up-transforming Boucherot bridge arrangement BBup1, then passes directly or through line W1 to the impedance-down-transforming Boucherot bridge arrangement BBdn1. The signal then passes directly or through W2 to the impedance-down-transforming Boucherot bridge arrangement BBdn2. The signal S is then fed from BBdn2 into the second section 10B of the waveguide 10. Here, too, the impedances Z_W1, Z_W2 are accorded the roles of intermediate impedances ZW1=Z_W1, ZW2=Z_W2.

In the third embodiment, the individual bridge arrangements may also be configured in such a way that the signal S can pass through the bridges in a manner free of reflections. As already explained, the following relationships result: Z_up1=sqrt(Z1A*Z_W1), Z_dn1=sqrt(Z_W1*Z_W2), Z_dn2=sqrt(Z_W2*Z1B). Given a corresponding design of the bridge arrangements BBup1, BBdn1, and BBdn2, it is provided that the signal S can pass through the device 100 in a manner free of reflections.

The effective damping of standing waves is achieved here, too, if the Boucherot bridge arrangements BBup1, BBdn1, BBdn2 are configured in such a way that their impedances Z_up1, Z_dn1, Z_dn2 are greater than the impedance of the waveguide 10, e.g., Z_up1>Z1, Z_dn1>Z1, Z_dn2>Z1.

The specific combination of one up-transforming bridge arrangement BBup1 with two down-transforming bridge arrangements BBdn1 and BBdn2 results in the first intermediate impedance ZW1 greater than the second intermediate impedance ZW2. The two-stage transformation effects transformation from the high intermediate impedance ZW1 via the lower intermediate impedance ZW2 back to the line impedance Z1.

FIG. 5 illustrates an embodiment in that the impedance transformation to the higher impedance is effected in a single act with the aid of BBup1, while the transformation to the lower impedance is achieved in two acts with the aid of BBdn1 and BBdn2. Of course, other variants can also be chosen (not shown). For example, the up-transformation can be effected in two acts (e.g., transformations) and the down-transformation is effected in a single act (e.g., transformation). More than two acts for the up- and/or down-transformation may be employed. A group 130 of Boucherot bridge arrangements having at least two different intermediate impedances that are greater than the line impedance Z1 arises in any variant.

Figure 6:
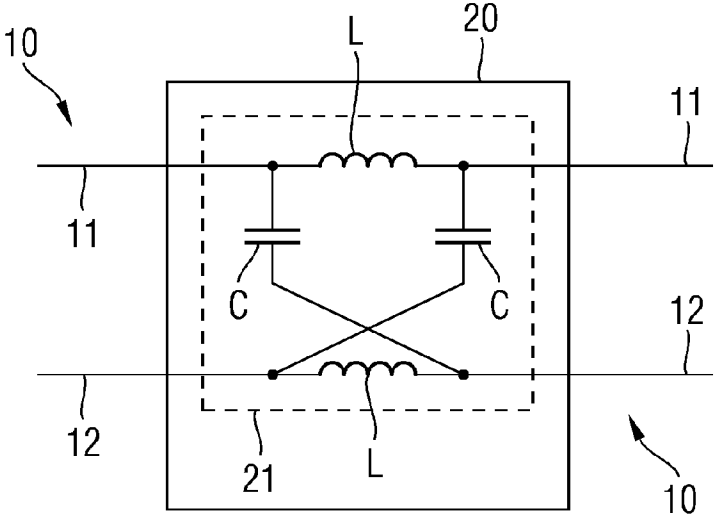
FIG. 6 illustrates the construction of a Boucherot bridge arrangement in one embodiment.

FIG. 6 illustrates the construction of a Boucherot bridge arrangement 20 in one simple embodiment. Each of the previously mentioned bridge arrangements BBup1, BBup2, BBdn1, BBdn2, BBUP, BBDN can be constructed like the simple Boucherot bridge arrangement 20 shown in FIG. 6.

The Boucherot bridge arrangement 20 in FIG. 6 consists of an individual Boucherot bridge 21 having two identical capacitances C and two identical inductances L. The interconnection and functioning of these components is known, per se, from the "Antennenbuch" previously mentioned, and will not be explained in any greater detail.

Alternatively, one or each of the Boucherot bridge arrangements BBup1, BBup2, BBdn1, BBdn2 may be constructed from a suitable interconnection of multiple individual Boucherot bridges 21, 22. The terms "Boucherot bridge arrangement" and/or "bridge arrangement" therefore encompass both the case that the respective Boucherot bridge arrangement, as illustrated in FIG. 6, consists of an individual Boucherot bridge 21, and the case shown in FIG. 7 in that the respective Boucherot bridge arrangement 20 is formed from a plurality of individual Boucherot bridges 21, 22 interconnected in a suitable manner. In both cases, the respective Boucherot bridge arrangement 20 has a predefined impedance ZB as a result of corresponding selection and inter-connection of inductances and capacitances.

Figure 7:
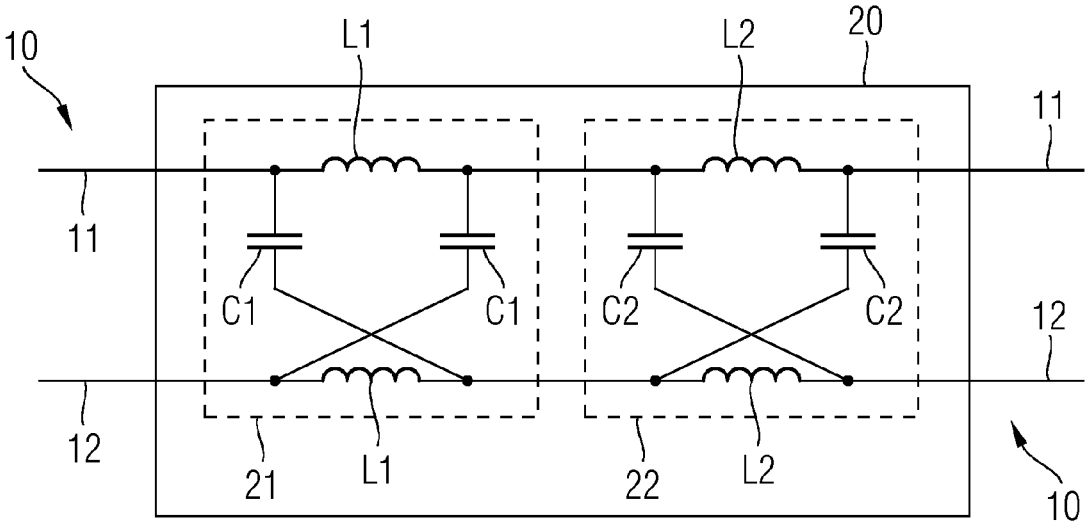
FIG. 7 illustrates the construction of a Boucherot bridge arrangement with multiple Boucherot bridges.

As illustrated in FIG. 7, Boucherot bridges 21, 22 each have two identical capacitances C1, C2 and inductances L1, L2. The individual bridges 21, 22 are identified or demarcated from one another by dashed lines.

As depicted in FIGS. 6 and 7, each Boucherot bridge 21, 22, the entire Boucherot bridge arrangement 20, and thus also the device 100 may each be considered a two-port network having two inputs and two outputs.

Figure 8:
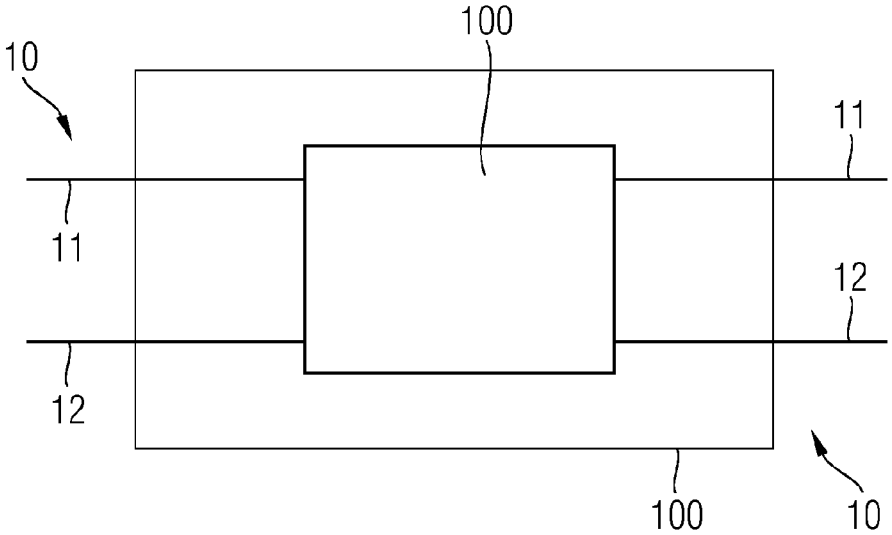
FIG. 8 illustrates an equivalent circuit diagram of the device for a push-pull signal.

FIG. 8 illustrates the customary interconnection suitable for the transmission of a push-pull signal. The device 100 is represented by a two-port network with the two inputs and the two outputs of the two-port network respectively connected to the wires 11, 12 of the waveguide 10. The two-port network represents the device 100 and, thus, two or more of the impedance-transforming bridge arrangements described above.

Figure 9:
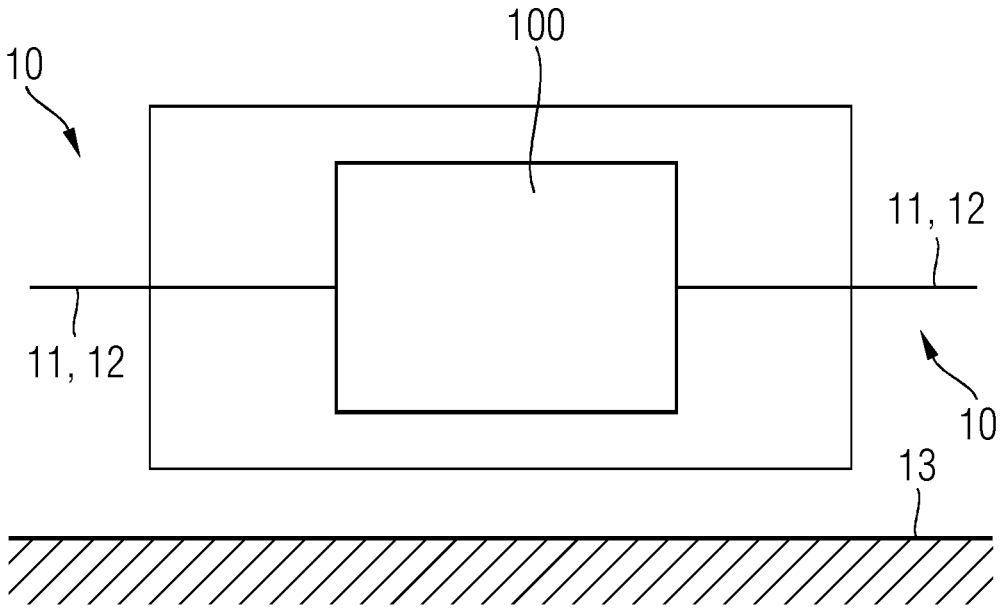
FIG. 9 illustrates an equivalent circuit diagram of the device for determining the damping for a common-mode signal.

FIG. 9 illustrates the equivalent circuit diagram for the transmission of a common-mode signal and for determining the damping for the common-mode signal. The Boucherot bridge arrangement 20 is again represented by a two-port network, where the wires 11 and 12 of the waveguide 10 are interconnected together with the two-port network 100. The external surroundings 13 of the waveguide 10, e.g. a floor, a wall, etc., function as return conductor.

In any embodiment, an impedance transformation from an input impedance, e.g., the impedance Z1 of the waveguide 10, to an intermediate impedance is carried out, wherein said intermediate impedance is greater than the input impedance, in order to achieve a better damping of the standing wave. This up-transformation can be carried out in one or more acts, e.g. with the aid of the bridge arrangements BBup1, BBup2. An impedance transformation from the intermediate impedance to a lower impedance at the output also may occur in any embodiment where the lower impedance generally corresponds to the impedance Z1 of the waveguide 10 at the input. This down-transformation can likewise be carried out in one act or in a plurality of acts, e.g. with the aid of the bridge arrangements BBdn1, BBdn2.

The family of terms "configured", "designed", etc., in association with electrical circuits, e.g. Boucherot bridges or Boucherot bridge arrangements, relates in particular to the selection of individual components of the circuits, e.g. capacitances C, inductances L and/or resistances R, that may be made in such a way that a specific effect is obtained, e.g. a predefined impedance. The corresponding circuit is designed in that case in such a way that the predefined impedance is achieved.

The intermediate impedances and the impedances of the bridge arrangements may be freely selected, in contrast to the generally predefined impedance Z1 of the waveguide 10. The higher a selected intermediate impedance, the greater the extent to which the common-mode signal is suppressed by the high inductance values of the Boucherot bridges. However, the damping for the useful signal also increases, and the bandwidth that can be transmitted decreases. In the context of an optimization, the impedance may be roughly described as a compromise solution for subsequently defining the exact impedance based on values of the available series of tolerances (e.g. E12) of the required components. The device 100 is intended for integration with installations with an operating frequency f, and the impedance Z1 of the waveguide 10 are often known values, an available standard value for the design of the Boucherot bridge arrangements may be selected for only one of either the inductances L or the capacitances C of the Boucherot bridge arrangements, while the respective unselected component may be adapted. Preferably, the standard value for the inductance L is selected, while the exact value for the capacitance C may be easily established individually by parallel connection of capacitances.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims may, alternatively, be made to depend in the alternative from any preceding or following claim, whether independent or dependent, and that such new combinations are to be understood as forming a part of the present specification.

While the present invention has been described above by reference to various embodiments, it may be understood that many changes and modifications may be made to the described embodiments. It is therefore intended that the foregoing description be regarded as illustrative rather than limiting, and that it be understood that all equivalents and/or combinations of embodiments are intended to be included in this description.

I claim:

1. A device for damping a standing wave on a waveguide carrying a signal in a propagation direction and having an impedance, comprising:

an input feeding the signal from the waveguide into the device;

an output outputting the signal from the device into the waveguide;

one or more groups of bridge arrangements, wherein each bridge arrangement of each group of bridge arrangements are connected in series between the input and the output of the device, wherein each bridge arrangement of each group of bridge arrangements are impedance-transforming Boucherot bridge arrangements, and wherein each bridge arrangement of the plurality of bridge arrangements has an impedance greater than an impedance of the waveguide.

2. The device of claim 1, wherein each group of bridge arrangements pass the signal through each respective group of bridge arrangements without signal reflections.

3. The device of claim 1, wherein each group of bridge arrangements of each respective group of bridge arrangements comprise:

an impedance up-transformation from an input impedance to a respective intermediate impedance, wherein the respective intermediate impedance is higher than the input impedance; and an impedance down-transformation from the respective intermediate impedance to a lower impedance.

4. The device of claim 3, wherein at least one group of the impedance up-transformation from the input impedance to the respective intermediate impedance comprises a different number of transformation steps than the impedance down-transformation from the respective intermediate impedance to the lower impedance.

5. The device of claim 1, wherein at least one group of bridge arrangements comprises:

more than two bridge arrangements, wherein, as viewed in the propagation direction of the signal through the device, the first bridge arrangement of the at least one group has a higher impedance than the last bridge arrangement of the group of bridge arrangements.

6. The device of claim 1, wherein at least one group of bridge arrangements comprises:

more than two bridge arrangements, wherein, as viewed in the signal propagation direction of the signal through the device, the first bridge arrangement of the at least one group of bridge arrangements has a lower impedance than the last bridge arrangement of the at least one group.

7. The device of claim 1, wherein at least one group of bridge arrangements comprises:

a pair of bridge arrangements, wherein the impedances of the two bridge arrangements of the pair are identical.

8. The device of claim 1, wherein each bridge arrangement comprises at least one Boucherot bridge, at least one of the bridge arrangements, or at least one Boucherot bridge and at least one of the bridge arrangements comprises:

a plurality of Boucherot bridges configured and interconnected with one another in such a way that the one bridge arrangement has a predefined total impedance value.

9. The device of claim 1, wherein at least one group of bridge arrangements comprises:

at least two successive bridge arrangements of the respective group of bridge arrangements are directly connected to one another.

10. The device of claim 1, wherein each bridge arrangement of a group of bridge arrangements are directly and respectively connected to one another.

11. The device of claim 1, comprising:

at least a first plurality of Boucherot bridge arrangements;

a second plurality of Boucherot bridge arrangements; and a line connecting a last bridge arrangement of the first plurality of Boucherot bridge arrangements in the signal flow direction to a first bridge arrangement of the second plurality of Boucherot bridge arrangements in the propagation direction of the signal.

12. The device of claim 2, wherein each group of bridge arrangements of each respective group of bridge arrangements comprise:

an impedance up-transformation from an input impedance to a respective intermediate impedance, wherein the respective intermediate impedance is higher than the input impedance; and an impedance down-transformation from the respective intermediate impedance to a lower impedance.

13. The device of claim 2, wherein at least one group of bridge arrangements comprises:

more than two bridge arrangements, wherein, as viewed in the propagation direction of the signal through the device, the first bridge arrangement of the at least one group has a higher impedance than the last bridge arrangement of the group of bridge arrangements.

14. The device of claim 3, wherein at least one group of bridge arrangements comprises:

more than two bridge arrangements, wherein, as viewed in the propagation direction of the signal through the device, the first bridge arrangement of the at least one group has a higher impedance than the last bridge arrangement of the group of bridge arrangements.

15. The device of claim 4, wherein at least one group of bridge arrangements comprises:

more than two bridge arrangements, wherein, as viewed in the propagation direction of the signal through the device, the first bridge arrangement of the at least one group has a higher impedance than the last bridge arrangement of the group of bridge arrangements.

16. The device of claim 2, wherein at least one group of bridge arrangements comprises:

more than two bridge arrangements, wherein, as viewed in the signal propagation direction of the signal through the device, the first bridge arrangement of the at least one group of bridge arrangements has a lower impedance than the last bridge arrangement of the at least one group.

17. The device of claim 3, wherein at least one group of bridge arrangements comprises:

more than two bridge arrangements, wherein, as viewed in the signal propagation direction of the signal through the device, the first bridge arrangement of the at least one group of bridge arrangements has a lower impedance than the last bridge arrangement of the at least one group.

18. The device of claim 4, wherein at least one group of bridge arrangements comprises:

more than two bridge arrangements, wherein, as viewed in the signal propagation direction of the signal through the device, the first bridge arrangement of the at least one group of bridge arrangements has a lower impedance than the last bridge arrangement of the at least one group.

19. The device of claim 2, wherein at least one group of bridge arrangements comprises:

a pair of bridge arrangements, wherein the impedances of the two bridge arrangements of the pair are identical.

20. The device of claim 3, wherein at least one group of bridge arrangements comprises:

a pair of bridge arrangements, wherein the impedances of the two bridge arrangements of the pair are identical.

* * * * *